US007967532B2

(12) United States Patent
Schmidt et al.

(10) Patent No.: US 7,967,532 B2
(45) Date of Patent: Jun. 28, 2011

(54) GROUND ANCHOR OR ROCK ANCHOR WITH AN ANCHOR TENSION MEMBER COMPRISED OF ONE OR MORE INDIVIDUAL ELEMENTS WITH CORROSION-PROTECTED ANCHOR HEAD DESIGN

(75) Inventors: Frank Schmidt, Munich (DE); Otmar Langwadt, Markt Schwaben (DE)

(73) Assignee: DYWIDAG-Systems International GmbH, Aschheim (DE)

( * ) Notice: Subject to any disclaimer, the term of this patent is extended or adjusted under 35 U.S.C. 154(b) by 241 days.

(21) Appl. No.: 12/361,372

(22) Filed: Jan. 28, 2009

(65) Prior Publication Data

US 2009/0191005 A1 Jul. 30, 2009

(30) Foreign Application Priority Data

Jan. 28, 2008 (DE) ..... 20 2008 001 248 U

(51) Int. Cl.
*E02D 5/08* (2006.01)
*E21D 20/00* (2006.01)
*E04C 5/12* (2006.01)

(52) U.S. Cl. ..... 405/259.1; 52/223.13; 52/223.14

(58) Field of Classification Search ..... 405/259.1; 52/223.13, 223.14, 231
See application file for complete search history.

(56) References Cited

U.S. PATENT DOCUMENTS 4,343,122 A * 8/1982 Wlodkowski et al. ..... 52/223.13
4,633,540 A * 1/1987 Jungwirth et al. ..... 14/22
4,773,198 A * 9/1988 Reinhardt ..... 52/223.13
4,918,887 A * 4/1990 Davis et al. ..... 52/223.13
5,386,675 A * 2/1995 Baur et al. ..... 52/250
5,440,842 A * 8/1995 Sorkin ..... 52/223.13
5,469,677 A * 11/1995 Luthi ..... 52/223.13
5,630,301 A * 5/1997 Sieg ..... 52/223.13
6,023,894 A * 2/2000 Sorkin ..... 52/223.8
6,056,482 A * 5/2000 Calandra et al. ..... 405/302.2
6,322,290 B1 * 11/2001 Calandra et al. ..... 405/259.1
7,174,684 B2 * 2/2007 Nuetzel et al. ..... 52/223.13
7,541,089 B1 * 6/2009 Miksic et al. ..... 428/379
2005/0210782 A1 * 9/2005 Kadotani et al. ..... 52/223.13

FOREIGN PATENT DOCUMENTS

DE 203 14 997 U1 2/2004

* cited by examiner

*Primary Examiner* — Tara Mayo-Pinnock
(74) *Attorney, Agent, or Firm* — Muncy, Geissler, Olds & Lowe, PLLC

(57) ABSTRACT

A ground anchor or rock anchor is provided that includes an anchor tension member composed of one or more individual elements, such as steel bars, steel wires, or steel wire strands. While the anchor tension member is intended to be introduced into a drilled hole and anchored there, the anchoring of the anchor tension member at the exposed end of the drilled hole is achieved with the aid of anchor head. To this end, the anchor head comprises a support element to bear directly or indirectly against the underlying rock or substratum, and an anchoring component for tensioning the individual elements, which can be brought into a frictional connection with the individual elements while bearing against the support element. In addition, a cap, which extends around the anchoring component and the ends of the individual elements, protects the exposed end of the anchor head. For secure attachment of the cap to the rest of the anchor head, between the support element and anchoring component, a connecting element is arranged that has a first closure component at its circumferential side, and has a second closure component of complementary shape on its circumferential side, wherein the first and second closure component work together to produce a frictional connection between the cap and connecting element.

17 Claims, 8 Drawing Sheets

GROUND ANCHOR OR ROCK ANCHOR WITH AN ANCHOR TENSION MEMBER COMPRISED OF ONE OR MORE INDIVIDUAL ELEMENTS WITH CORROSION-PROTECTED ANCHOR HEAD DESIGN

This nonprovisional application claims priority under 35 U.S.C. §119(a) to German Patent Application No. 20 2008 001 248.1, which was filed in Germany on Jan. 28, 2008, and which is herein incorporated by reference.

BACKGROUND OF THE INVENTION

1. Field of the Invention

The invention relates to a ground anchor or rock anchor having an anchor tension member composed of one or more individual elements and having a corrosion-protected anchor head design.

2. Description of the Background Art

Ground and rock anchors are typically used when it is necessary to transmit forces in the region of the anchor head to deeper soil strata. For this purpose, generic anchors have an anchor tension member, which can be composed, for example, of a single bar anchor, which as a general rule has a continuous external thread. Such anchors are known in the form of rock bolts or soil nails, which are either bonded to the wall of the drilled hole over their entire length by the introduction of an injected grout and are subsequently tensioned, or in the type known as post-tensioned anchors are anchored only in the area of the base of the drilled hole and are prestressed at the exposed end. The tensioning or prestressing is accomplished by an anchor nut that is screwed onto the thread of the bar anchor and bears against an anchor plate.

In addition, conventional anchors with an anchor tension member composed of multiple individual elements are known. The individual elements are usually composed of steel wire strands that are anchored to the wall of the drilled hole in the innermost part of the drilled hole. As a rule, such anchors are produced in the form of post-tensioned anchors. Since the wire strands have no external threads, the anchor provides a head block in the vicinity of the anchor head, in which the steel wire strands are frictionally held by anchoring wedges.

Ground and rock anchors are used for both temporary and permanent applications, with permanent use requiring a design that is suitable for protecting against corrosion. In this context, a distinction is drawn between corrosion protection in the region inside the drilled hole, in which passivation is achieved by injecting grout into the drilled hole, and which sometimes is supplemented by plastic sheathing, [and protection outside the hole]. In the region of the anchor head, which is to say outside the drilled hole, corrosion protection is achieved by covering the exposed parts with a corrosion protection compound, such as grease, for example.

From DE 203 14 997 U1 is known a prestressed ground anchor with a plurality of steel wire strands as the anchor tension member, which is introduced into a drilled hole and is anchored at the exposed end in an anchor plate by a head block and wedges. The free ends of the individual steel wire strands project past the head block so that their ends can be gripped by a tensioning jack in the event of the retensioning or removal of individual strands.

In order to ensure corrosion protection in the area of the anchor head, a cap that encloses the head block and the projecting ends of the steel wire strands is provided; the cap is filled with a corrosion protection compound and is fastened to the anchor plate at a circumferential flange using screws.

This type of corrosion protection has been proven in practice. However, it has been noted that the anchor head is also frequently provided with protective paint at a later time, which covers the heads of the fastening screws as well. Especially in the event of a later removal of the cap as part of maintenance or repair work, it is then necessary to remove paint residue from the screw heads, which entails considerable effort.

SUMMARY OF THE INVENTION

It is therefore an object of the invention to improve the design of the anchor head, in particular with regard to facilitating the work of installation and removal.

In an embodiment, a closure component is provided for attaching the cap to the rest of the anchor head in an area that is not accessible from outside, for example in the protected area inside the cap. In accordance with the invention, this can be accomplished by a connecting element that extends substantially concentrically around the individual elements and is connected to a support element. At its outer circumference, the connecting element provides a first closure component, which works together with a second closure component on the inner circumference of the cap. In this way, the function of the closure component is not impaired by subsequent external activities such as protective painting or mechanical damage, for example. Moreover, the corrosion protection inside the cap ensures that the closure component is also protected from corrosion, so that their function is maintained over the long term, and removal of the cap is still possible without difficulty after many years.

A further advantage is that the closure component can be activated in the process of putting on the cap, which can be done very quickly and thus provides a considerable reduction in effort as compared to attachment by screws.

Since the closure component is not visible from outside, an inventive anchor is characterized by an improved external appearance, and is less apt to tempt third parties, for whom the closure component is not visible, to inappropriately remove the cap. A cap design that requires the use of special tools to remove the cap can further contribute to preventing misuse. Thus, the center of the cover of the threaded cap can be provided with a recess or a projection having a polygonal cross-section, for example in the shape of a regular square or hexagon, which can be engaged by a tool of suitable shape. Alternatively, the circumference of the threaded cap can have a component which can be brought into frictional engagement with a tool, for example flat or profiled surfaces that are suitable for placement of a tool.

According to an embodiment of the invention, the connecting element can include a circular washer which can be placed on the individual elements, which is clamped between the anchor nut and anchor plate, and whose outer circumference interacts with the closure component on the inner circumference of the cap. In this case the anchor plate serves as a support element. Such an embodiment is advantageous from a production standpoint because a separate part that is only combined with the other parts at the installation of the anchor head is simple and economical to produce.

In an alternative embodiment, the connecting element can be made of a cylindrical projection extending as a single piece from the anchor plate, which provides advantages especially during installation of the anchor, since no separate parts need to be supplied and handled.

The closure component for attaching the cap to the rest of the anchor head arrangement can include a thread, in particular a coarse thread. This makes it possible to attach the cap quickly and securely to the anchor head. In the process, the cap connects to the anchor plate in a frictional and sealing manner over its entire circumference.

An alternative to this is a closure component in the form of a bayonet catch, which can also have a rapid and secure closing mechanism.

The invention is possible for anchors both with and without angle compensation; in the case of angle compensation, the closure element is arranged with the closure component at or on a domed plate. In this case the domed plate serves as the support element. The invention consequently has a very broad field of application.

This is also demonstrated by the inventive embodiment of the invention for anchors with multiple individual elements, such as multistrand anchors, in which the closure component can be arranged on the outer circumference of the head block, or even on the anchor plate itself.

Another embodiment of the invention shows that it is also possible to arrange the closure component on the outer circumference of the cap. In this case, the connecting element can be composed of a circumferential shoulder, which projects monolithically from the top of the circular washer, domed plate, anchor plate, or head block, and on whose inner circumference the complementary closure component run.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein:

FIG. 2 is a partial section of the anchor shown in FIG. 1 in a region of the anchor head while a cap is being put on;

DETAILED DESCRIPTION

Figure 1:
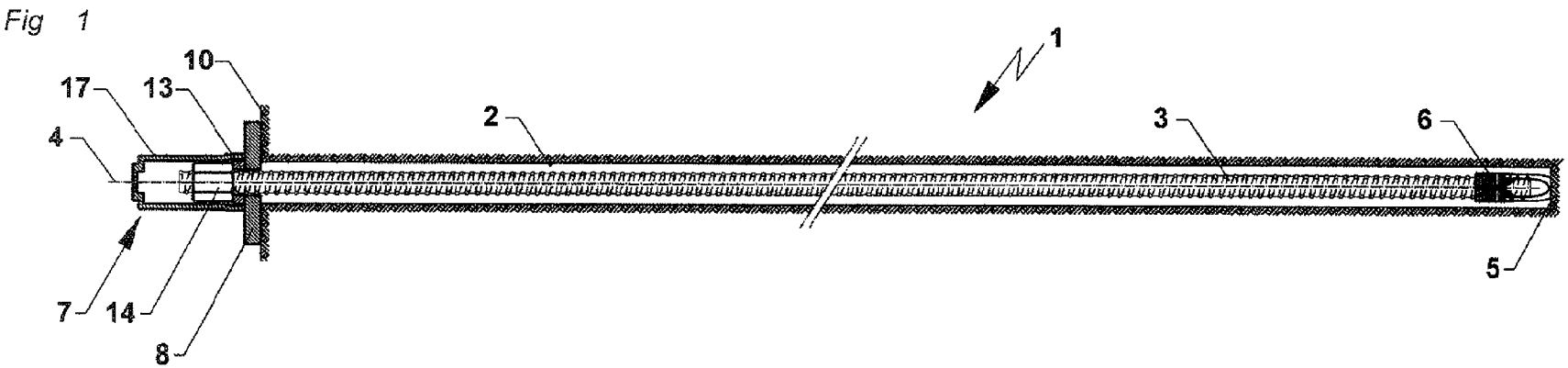
FIG. 1 is a longitudinal section through an anchor in an installed state, according to an embodiment of the invention.
Figure 2:
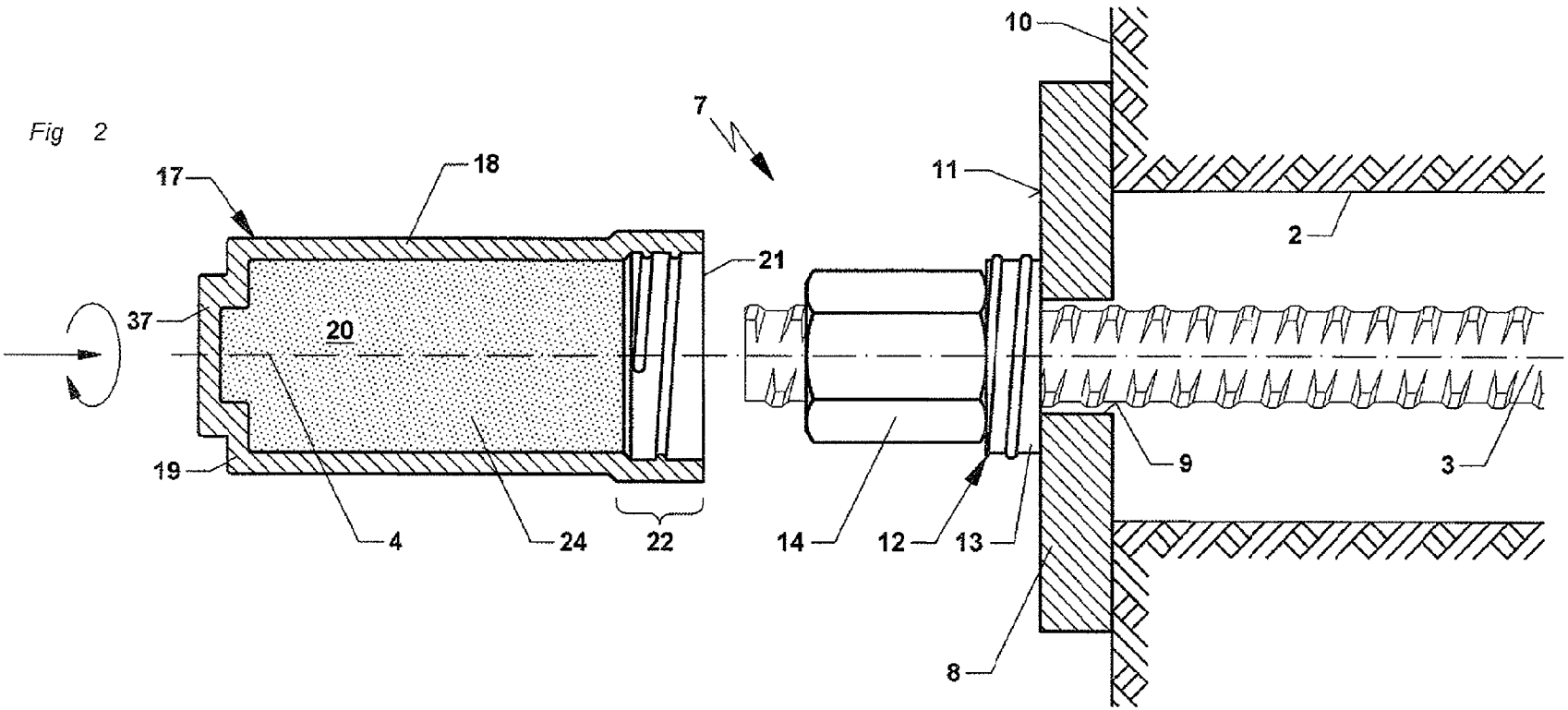
Figure 3:
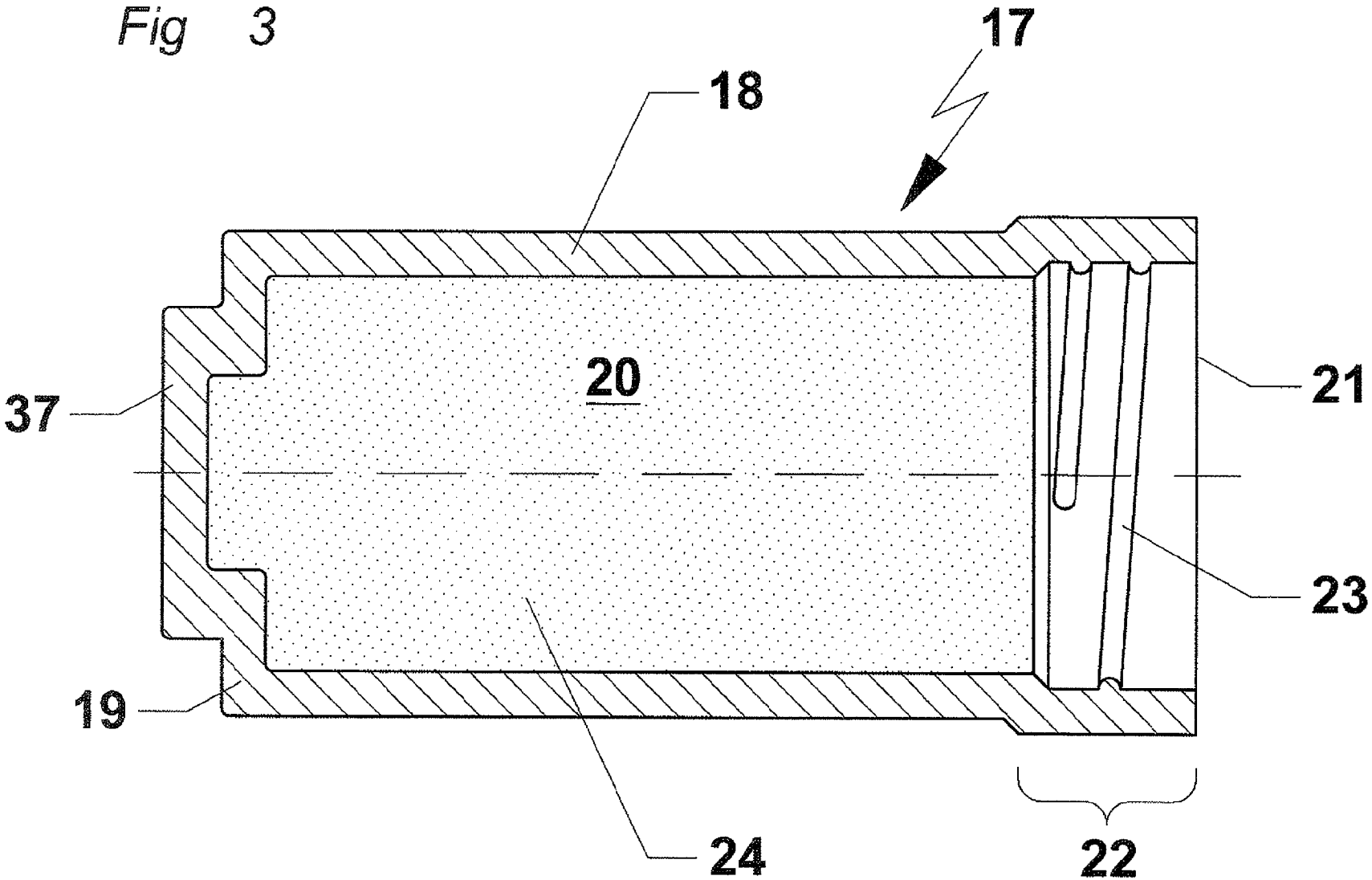
FIG. 3 is a longitudinal section through a cap equipped with a closure component.

FIG. 1 through 3 show a first embodiment of the invention, wherein FIGS. 1 and 3 also apply analogously to the embodiments of the anchor head design shown in FIG. 4 through 8 whenever the design construction permits.

Visible is a rock anchor 1, which is located inside a drilled hole 2. The anchor tension member of the rock anchor 1 consists of a single individual element in the form of a ribbed steel bar 3 whose longitudinal axis is labeled with reference number 4. In the bottom of the drilled hole 5, the rock anchor 1 is anchored against tension by a wedge anchor 6 screwed onto the steel bar 3.

The exposed end of the rock anchor 1 is composed of the anchor head 7, whose design construction is shown in a larger scale in FIG. 2. Visible is an anchor plate 8 covering the opening of the drilled hole 2, which plate can have a rectangular or round circumference and is equipped with a centered hole 9 for passage of the steel bar 3. The underside of the anchor plate bears against the underlying rock or substratum 10, while the top 11 serves as a support for a circular washer 12 arranged concentrically to the hole 9. The circular washer 12 is threaded onto the free end of the steel bar 3, and has on its outer circumference closure component in the form of an external thread 13.

An anchor nut 14 is screwed onto the thread of the steel bar 3, thereby bracing the circular washer 12 against the top 11 of the anchor plate 8, so that the circular washer 12 is held in a rotationally fixed manner between the anchor nut 14 and anchor plate 8 on the steel bar 3.

In the drilled hole 2, the rock anchor 1 can be partially or entirely surrounded by a grout in order to ensure corrosion protection within the drilled hole in this way.

FIG. 3 shows an inventive cap 17, which serves to provide corrosion protection in the region of the anchor head 7. The cap 17 is composed of a hollow cylinder 18, one end of which is sealed with a cover 19. A bell-shaped cavity 20 is produced as a result. The end of the cap 17 facing the opening 21 is composed of a threaded section 22, which is provided with an internal thread 23. To guarantee corrosion protection, the cavity 20 is filled with a corrosion protection compound 24.

It is evident from FIG. 2 that such a cap 17 is pushed axially onto the anchor head 7 until the threaded section 22 contacts the circular washer 12. A tight seal between the cap 17 and anchor plate 12 is brought about by screwing the internal thread 23 of the cap 17 onto the external thread 13 of the circular washer 12 until the edge of the opening 21 contacts the top 11 of the anchor plate 12.

If desired, the cap 17 can be further developed by appropriately designing the circumference or cover for positive engagement of a special tool to screw on the cap 17. The coaxial hexagonal projection 37 shown on the outside of the cover 19 of the cap 17 in FIGS. 1 to 6 serves this purpose. Alternatively, the projection 37 can also be formed by a suitably shaped recess or by suitably shaped surfaces on the outer circumference of the hollow cylinder 18 of the cap 17.

Figure 4:
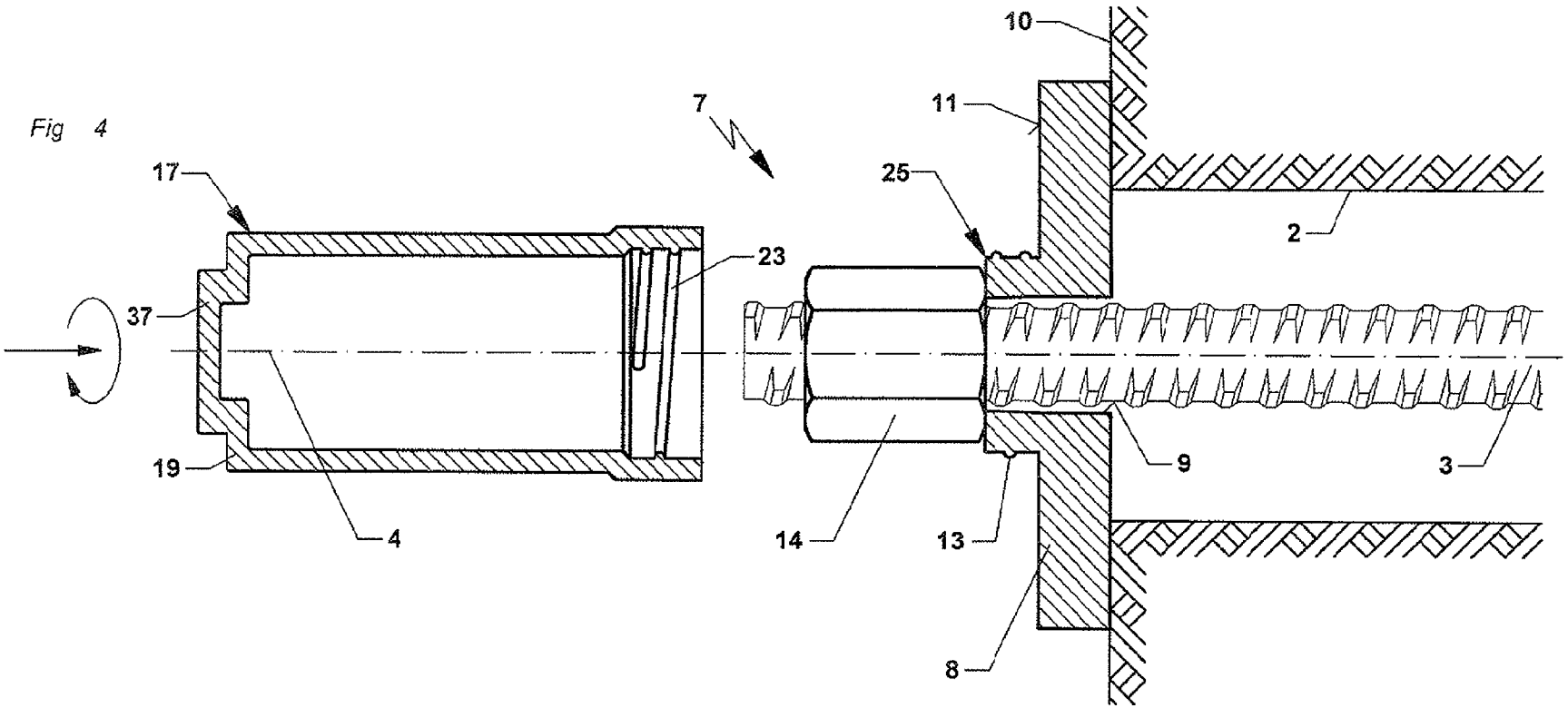
FIG. 4 is a partial section through another embodiment of the invention in the region of the anchor head.

The embodiment of the invention shown in FIG. 4 matches those previously described in most respects. The only significant difference is that the closure component are formed by a cylindrical projection 25 that extends as a single piece from the top 11 of the anchor plate 8. The outer circumference of the projection 25 carries a thread 13 that cooperates with the internal thread 23 of the cap 17 as a closure component during the fastening of said cap. Alternatively, it is possible to provide the closure component directly on the outer circumference of the anchor plate 8, which necessitates a correspondingly large diameter of the cap 17.

Figure 5:
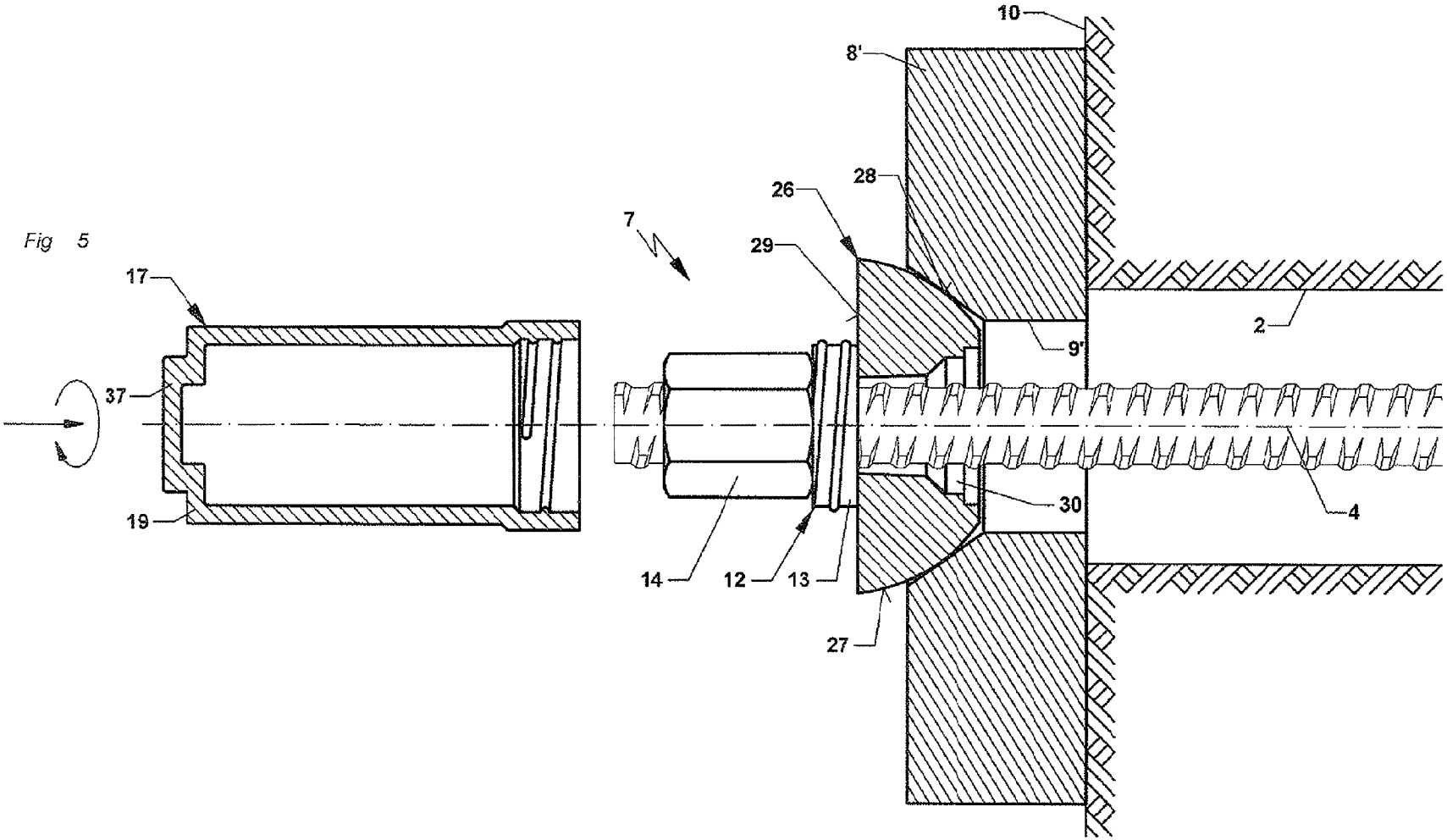
FIG. 5 is a partial section through an anchor with angle compensation in the region of the anchor head.
Figure 6:
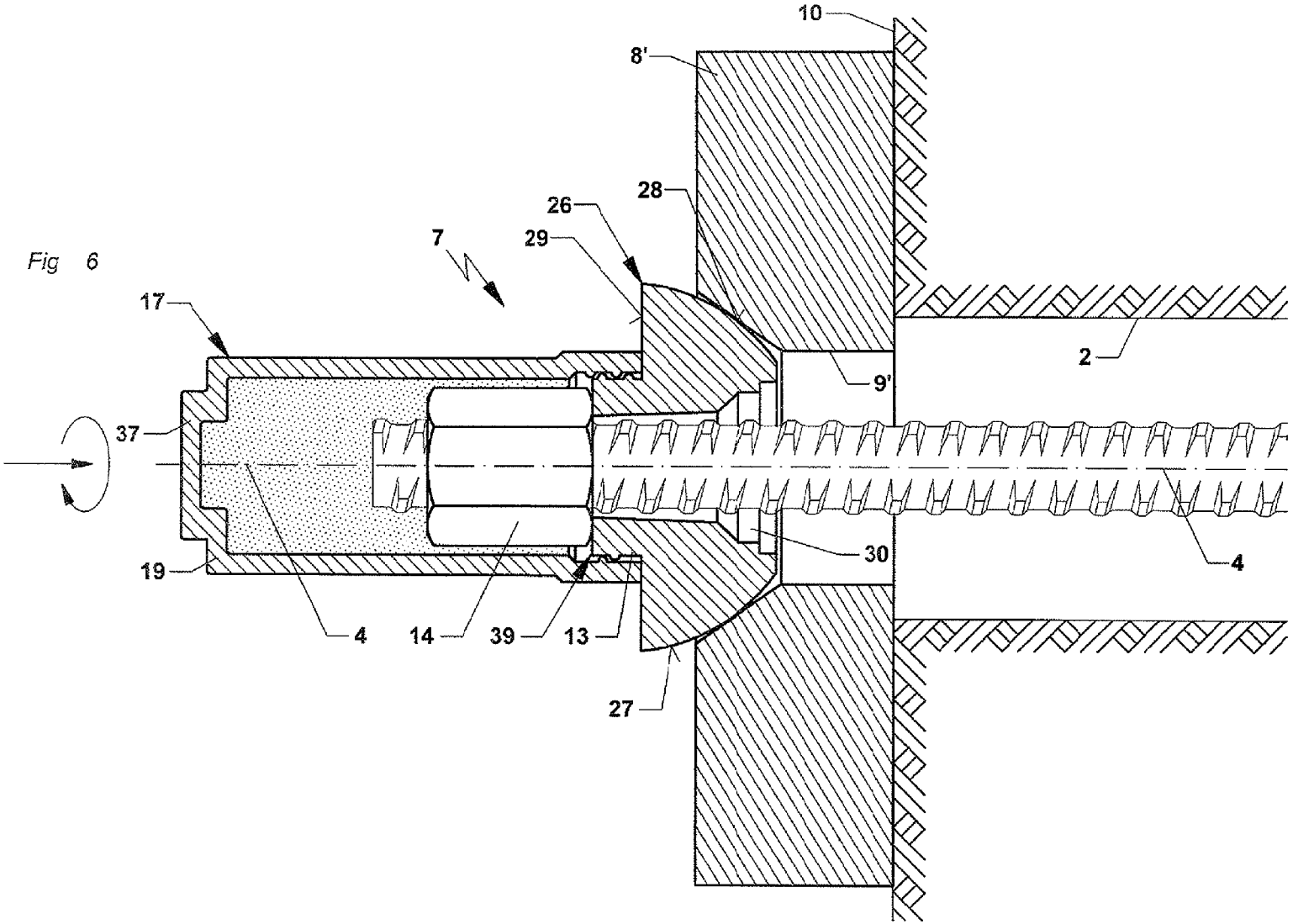
FIG. 6 is another embodiment of an anchor with angle compensation in the region of the anchor head.

While FIG. 1 through 4 show anchors 1 whose tension member extends perpendicular to the top 11 of the anchor plate 8, FIGS. 5 and 6 relate to applications where the longitudinal axis 4 is inclined relative to the anchor plate 8. This necessitates angle compensation in the vicinity of the anchor head 7 so that the anchor 1 is only subjected to a purely tensile loading.

To this end, in the embodiments in FIGS. 5 and 6 a domed plate 26 is interposed between a modified anchor plate 8' and the anchoring component. The domed plate 26 has a crowned underside 27 that rests against the modified anchor plate 8'. The modifications to the anchor plate 8' consist of an enlargement of the central hole 9' and spherical support surfaces 28 in the area of the contact joint with the domed plate 26. In this way, the domed plate and the anchor plate 8' together form a ball joint that permits tilting motions of the domed plate 26 relative to the anchor plate 8'.

The embodiment of the invention shown in FIG. 5 has a domed plate 26 with a flat top 29, which serves to support a circular washer 12. The circular washer 12 corresponds to those already described in the preceding example embodiments, and has an external thread 13 as a closure component. In addition, the domed plate 26 has a centered through-hole 30 that enlarges in a stepped or conical manner towards the underside 27 for passage of the steel bar 3. Otherwise the discussion under FIGS. 1 and 4 applies analogously.

The embodiment of the invention shown in FIG. 6 differs from those previously described in that, instead of the loose circular washer 12, the connecting element is a cylindrical projection 39 worked as a single piece from the top 29 of the domed plate 26, which has a thread 23 on its outer circumference as closure component. This embodiment thus corresponds analogously to the one described in FIG. 4; in order to avoid repetition, please refer to the applicable part of the description.

Figure 7:
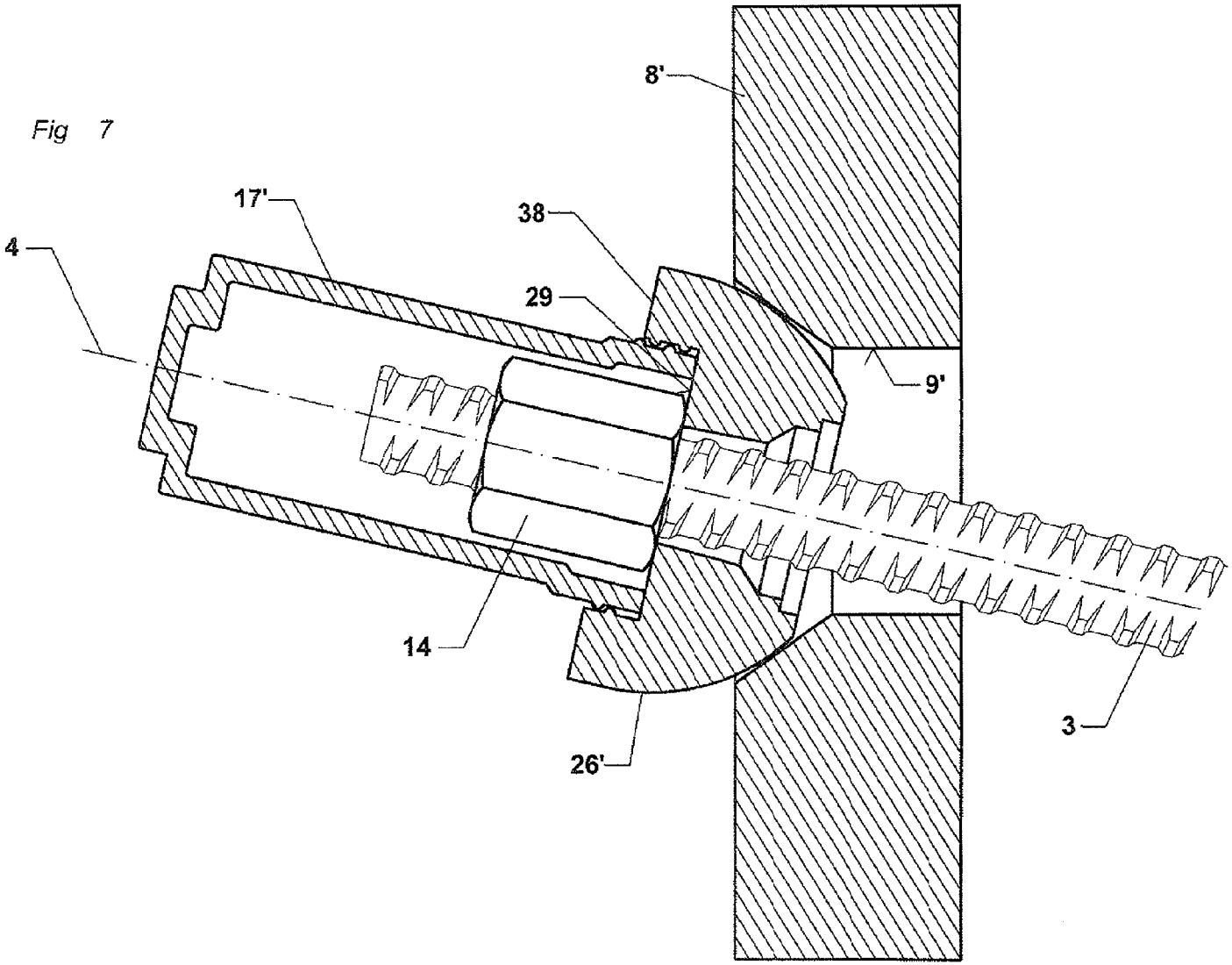
FIG. 7 is an additional embodiment of an anchor with angle compensation in the region of the anchor head.

Another embodiment of the invention is shown in FIG. 7. Visible there is a modified domed plate 26', which bears against an anchor plate 8', and which is characterized by a shoulder 38 extending around the circumference of, and projecting from the top 29' of, the domed plate 26'. On its inside facing the longitudinal axis 4, the shoulder 38 is equipped with closure component, for example with a thread, which work together with complementary closure component on the outer circumference of the cap 17' to produce a frictional connection. In this embodiment, the bottom edge of the cap 17', which is provided with the closure component, is protected in a recess formed by the shoulder 38.

Figures 8A, 8B:
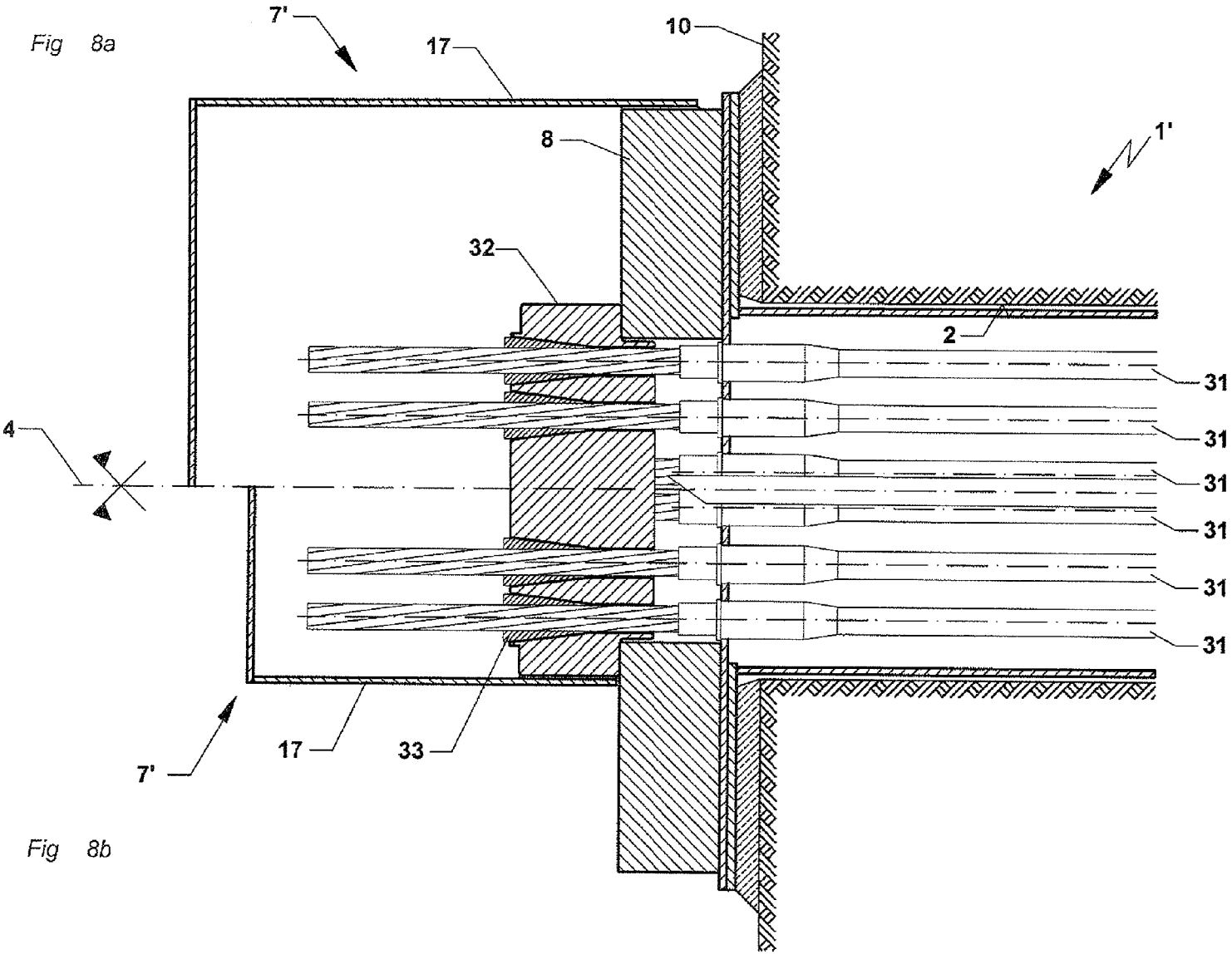
FIGS. 8*a*, 8*b* are, in each of these, a half section through an anchor head of an anchor with multiple individual elements.

FIGS. 8*a* and 8*b* show the implementation of the invention in an anchor 1' whose anchor tension member has multiple individual elements in the form of steel wire strands 31. Because of the symmetry that is present with respect to the longitudinal axis 4, FIGS. 8*a* and 8*b* each show just one half of the anchor head 7' for the sake of simplicity.

Both the anchor 1' shown in FIG. 8*a* and that shown in FIG. 8*b* have a plurality of steel wire strands 31, which are gathered into a bundle in the anchoring region and emerge from the drilled hole 2. The drilled hole 2 is bordered by an anchor plate 8, which bears against the underlying rock or substratum 10, and which is provided with a central opening that is aligned with the drilled hole 2. The anchor plate 8 serves as a bearing surface for a coaxially placed head block 32, which is provided with a number of through-holes corresponding to the number of steel wire strands 31; these through-holes expand conically toward the ends of the steel wire strands 31. The steel wire strands 31 are threaded through the through-holes, and are anchored in a known manner with the aid of conical anchoring wedges 33, which are arranged in the conical section of the through-holes.

In order to attach a protective cap 17 to the anchor head 7', the anchor plate 8 serves as a connecting element. First closure component, for example a thread, extending around the outer circumference of the anchor plate 8 work together with second closure component of complementary design on the inner circumference of the cap 17 for this purpose.

The embodiment in FIG. 8*b* differs therefrom in that the first closure component are not arranged on the anchor plate 8, but instead are arranged on the outer circumference of the head block 32, and again make a frictional connection with the second closure component on the inner circumference of the cap 17.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A ground anchor or rock anchor having an anchor tension member having one or more individual elements and an anchor head, the anchor head comprising:

a support element to bear directly or indirectly against an underlying rock or substratum;

an anchoring component for tensioning the individual elements, the anchoring component being configured to be brought into a frictional connection with the individual elements while bearing against the support element;

a cap that extends substantially around the anchoring component and ends of the individual elements at an exposed end of the anchor head; and a connecting element arranged between the support element and the anchoring component, the connecting element having a first closure component at a circumferential side and said cap having a second closure component on a circumferential side, the first and second closure components functioning together to produce a frictional connection between the cap and connecting element, and wherein the first closure component is arranged on an outer circumference of the connecting element and the second closure component is arranged on an inner circumference of the cap, or wherein the first closure component is arranged on an inner circumference of a circumferential shoulder of the connecting element and the second closure component is provided on an outer circumference of the cap.

2. The anchor according to one of claim 1, wherein the connecting element comprises a substantially circular washer that is arranged on the individual elements, which are inserted and clamped between the support element and the anchoring component.

3. The anchor according to claim 1, wherein the connecting element comprises a hollow, cylindrical projection that extends as a single piece from the support surface of the support element, such that it extends around one or more individual elements.

4. The anchor according to claim 1, wherein the first closure component of the connecting element and the second closure component of the cap includes cooperating threads.

5. The anchor according to claim 1, wherein the first closure component of the connecting element and the second closure component of the cap form a bayonet catch.

6. The anchor according to claim 1, wherein the support element includes an anchor plate.

7. The anchor according to claim 1, wherein the support element includes a domed plate.

8. The anchor according to claim 1, wherein the anchoring component includes an anchor nut that is configured to be screwed onto an external thread on an end of the individual elements.

9. The anchor according to claim 1, wherein the anchoring component includes a head block with anchoring wedges.

10. The anchor according to claim 1, wherein the cap has on an outer surface a component for placement of a tool.

11. The anchor according to claim 10, wherein the component on the cap includes a centered square or hexagonal recess or projection on a cover of the cap.

12. The anchor according to claim 10, wherein the component on the cap has a flat or profiled surface on a circumference of the cap.

13. The anchor according to claim 1, wherein the ground anchor or rock anchor is a permanent anchor.

14. The anchor according to claim 1, wherein the individual elements are steel bars, steel wires, or steel wire strands.

15. The anchor according to claim 1, wherein the anchor tension member is configured to be introduced into a drilled hole and anchored therein.

16. The anchor according to claim 1, wherein the anchor head is configured for anchoring the anchor tension member at an exposed end of the drilled hole.

17. The anchor according to claim 1, wherein the second closure component has a substantially complementary shape to the first closure component.

* * * * *